US007273162B2

(12) United States Patent
Baker

(10) Patent No.: US 7,273,162 B2
(45) Date of Patent: Sep. 25, 2007

(54) FRY AND FOOD SCOOP WITH CONDIMENT CELLS

(75) Inventor: Mark P. Baker, Fort Wayne, IN (US)

(73) Assignee: Altivity Packaging, LLC, Elk Grove Village, IL (US)

( * ) Notice: Subject to any disclaimer, the term of this patent is extended or adjusted under 35 U.S.C. 154(b) by 74 days.

(21) Appl. No.: 11/057,720

(22) Filed: Feb. 14, 2005

(65) Prior Publication Data

US 2006/0180644 A1 Aug. 17, 2006

(51) Int. Cl.
*B65D 25/04* (2006.01)

(52) U.S. Cl. ..... 229/120.13; 229/103; 229/400; 229/906

(58) Field of Classification Search ..... 229/120.13, 229/400, 405, 902, 904, 906, 104, 164
See application file for complete search history.

(56) References Cited

U.S. PATENT DOCUMENTS

| | | | | | |
|---|---|---|---|---|---|
| 512,571 | A | * | 1/1894 | Walker | 229/104 |
| 1,300,164 | A | * | 4/1919 | Guardino | 229/104 |
| 2,757,852 | A | * | 8/1956 | Stedman et al. | 229/164 |
| 3,261,535 | A | * | 7/1966 | Krause | 229/164 |
| 3,567,105 | A | | 3/1971 | Mc Farlin | |
| 3,845,897 | A | * | 11/1974 | Buttery et al. | 229/104 |
| 3,877,632 | A | * | 4/1975 | Steel | 229/104 |
| 4,126,261 | A | | 11/1978 | Cook | |
| 4,227,640 | A | * | 10/1980 | Roccaforte | 229/104 |
| 4,552,293 | A | * | 11/1985 | Blagg et al. | 229/400 |
| 4,714,190 | A | | 12/1987 | Morrocco | |
| 4,854,466 | A | | 8/1989 | Lane, Jr. | |
| 4,955,528 | A | | 9/1990 | Schluckebier | |
| 5,348,218 | A | * | 9/1994 | Haire et al. | 229/164 |
| 5,417,364 | A | | 5/1995 | Shaw | |
| 5,540,333 | A | | 7/1996 | Gonzalez et al. | |
| 5,626,283 | A | | 5/1997 | Mellon | |
| 5,630,544 | A | | 5/1997 | Shane | |
| 5,718,337 | A | * | 2/1998 | Carr et al. | 229/164 |
| 5,720,429 | A | | 2/1998 | Cordle | |
| 5,842,631 | A | | 12/1998 | Berger | |
| 5,875,957 | A | | 3/1999 | Yocum | |
| 6,102,208 | A | | 8/2000 | Huang | |
| 6,119,930 | A | | 9/2000 | Lunstra et al. | |

(Continued)

FOREIGN PATENT DOCUMENTS

| | | |
|---|---|---|
| AU | 34024/93 | 10/1993 |

(Continued)

*Primary Examiner*—Gary E Elkins
(74) *Attorney, Agent, or Firm*—Armstrong Teasdale LLP

(57) ABSTRACT

A fry scoop with one or two cells store food and condiments within a folded container. The fry scoop starts as a single blank with a rear panel, a rear wall, a bottom, a front wall with flanking side panels, and a front panel. The panels fold onto their respective walls, the walls fold upwardly from the bottom, and the sides then fold and attach to the rear wall. With the sides, front wall, and rear wall upright, an open top food container forms. Pulling the front and rear panels inwards opens two condiment cells. The front and rear panels have similar edge shapes and attain the same height from the bottom. The similarity between the front and the rear of the present invention allows consumers, or restaurant staff, to load the scoop from the front or the rear.

7 Claims, 7 Drawing Sheets

U.S. PATENT DOCUMENTS 6,182,890 B1 * 2/2001 Sattler et al. ..... 229/400
6,349,874 B1 2/2002 Hill
6,386,443 B1 5/2002 Szczerbinski
6,419,153 B1 7/2002 Maita
6,471,119 B2 10/2002 Cai
6,543,679 B2 4/2003 Cai et al.
6,588,652 B2 * 7/2003 Cai ..... 229/902
6,612,485 B2 9/2003 Lackner et al.
6,705,514 B2 3/2004 Pellati
7,140,532 B2 * 11/2006 Holt et al. ..... 229/120.13
2002/0125306 A1 * 9/2002 Jamitzky et al. ..... 229/904

FOREIGN PATENT DOCUMENTS

DE 8808196 U1 * 10/1988
GB 2147275 A * 5/1985

* cited by examiner

FRY AND FOOD SCOOP WITH CONDIMENT CELLS

CROSS REFERENCE TO RELATED APPLICATION

This nonprovisional patent application claims priority to the design patent application upon the same invention, having Ser. No. 29/223,411, and which was filed on Feb. 14, 200, which applications have been filed on the same date.

BACKGROUND OF THE INVENTION

The fry scoop with condiment cells relates to fast food packages in general and more specifically to the open top containers for French fried potatoes and other long foods. Creased panels, upon folding, form cells on the interior of the scoop for condiments. The fry scoop, when placed in an erected or expanded condition, receives food in the main compartment and condiments in the adjacent cells.

Fry scoops have had much use over the years in containing French fries, onion rings, French toastix™, fish, and other long food items. The food items are cooked fast, packaged fast, and served fast to the consumer. Prior art scoops start from a single blank of material. Cut and scored, prior art scoops fold into open top containers for food. Some scoops have a higher rear panel than the front panel for their own purposes. Different scoops have flat bottoms while some have arcuate bottoms. Fast food restaurants have the scoops printed with food chain logos and other marketing images. Complicated machinery performs the intricate creasing, scoring, cutting, folding, and gluing that forms a blank into a scoop. Made from a single blank, most prior art scoops do not contain liquid and semisolid condiments. Consumers desire condiments to add personal taste to the French fries. Restaurants have prepackaged condiments, of mustard and ketchup, or bulk condiments served in small paper cups. Consumers have to carry both the condiment and a prior art fry scoop. After much spilled ketchup later, consumers now seek a scoop to hold both food and condiments.

DESCRIPTION OF THE PRIOR ART

Fry scoops and other containers for fast food items are known in the prior art. Older scoops contained the food and displayed the food visible from the front against a higher rear panel. Some scoops worked in tandem with a separate container for condiments.

The patent to Lane, Jr., U.S. Pat. No. 4,854,466, shows a hanging package cup, wherein the cup for the condiment is suspended to the side, separately hooked thereon.

The patent to Schluckebier, U.S. Pat. No. 4,955,528, shows a container for food and condiments with food in one container, and then a second container for condiments. Here, the second container for condiments is adjacent to the first container, and the second container has its bottom edge sealed to the back of the first container to form the second container.

The patent to Shaw, U.S. Pat. No. 5,417,364, shows a ketchup pocket basket, but located at the bottom of the front side. The patent to Gonzalez, et al., U.S. Pat. No. 5,540,333, shows a French fry bag, having a supplemental bag appended to the outer surface of the first bag, forming a ketchup pouch. The patent to Berger, U.S. Pat. No. 5,842,631, discloses a condiment compartment for quick scoop food cartons applied to the exterior surface of a first scoop carton.

The patent to Cordle, U.S. Pat. No. 5,720,429, shows a food container with flip-out condiment pocket. The '429 patent includes a main paperboard container, for holding French fries, with an integrally formed pocket panel that projects outwardly from the side of the rear panel upon popping into an open condition.

The patent to Yocum, U.S. Pat. No. 5,875,957, shows a food scoop with condiment compartment. This food scoop includes a primary container, and a pocket formed adjacent to one of its walls. Here the pocket forms as a sheet against the interior of the said wall. This patent defines that the top edge of the pocket sheet is substantially linear and extends across the concave extent of the upper edge of either the front or the back wall of the scoop, and that the pocket sheet is generally upwardly spaced in relation to the first wall's upper edge. It defines that the rear wall of the scoop is vertically above the upper edge of the front wall. But in the present invention, the front and back walls are at the same height so it can be used either way and exhibits greater stability.

The patent to Huang, U.S. Pat. No. 6,102,208, shows a disposable French fries accommodating container assembly with a fixed small container for seasonings and sauce. The condiment container forms externally of the French fries container.

The patent to Lunstra, et al., U.S. Pat. No. 6,119,930 shows a carton with an integral discrete compartment adhesively applied at its shoulders to two adjacent back wall panels. The compartment pops out to form a cavity.

The patent to Hill, U.S. Pat. No. 6,349,874 shows a container with another integral discrete compartment that overlaps an outer wall panel to form an integral discrete second compartment.

The patent to Szczerbinski, U.S. Pat. No. 6,386,443, shows a combination food and condiment dispenser. This dispenser includes a cut out portion in at least one side panel and attaches to the front and back panel, to form the condiment container.

The patent to Maita, U.S. Pat. No. 6,419,153, shows a combination food container and sealed condiment dispenser. The condiment dispenser for this particular container generally appends to either the front or the sides.

The patent to Cai, U.S. Pat. No. 6,471,119, shows a food scoop with condiment holder. This particular holder is very similar to Hill's '874 patent which discloses a food scoop with a first compartment and a second compartment appending to the first and second walls.

The patent to Pellati, U.S. Pat. No. 6,705,514, shows another shaped container with a condiment sub-container in a corner.

The patent to Cook, U.S. Pat. No. 4,126,261, shows a condiment container that is applied to one of the sides of the principal container. In this case, the container appears to be more of a tray. The patent to Gonzalez, U.S. Pat. No. 5,540,333, shows the application of a V-shaped panel located on the outside of the bag. The patent to Mellon, U.S. Pat. No. 5,626,283, has a fold out pouch compartment. The patent to Gordle, U.S. Pat. No. 5,720,429, has the condiment pocket applied to a side wall. The patent to Cai, U.S. Pat. No. 6,543,679, applies the condiment patch in the corner, or along the end panels.

While the above-described devices fulfill their respective, particular objectives and requirements, the aforementioned patents do not describe a fry scoop with multiple cells that contains condiments with the food. Therefore, a need exists for a new and improved fry scoop with cells that can be used for containing the sauce or different condiments adjacent to food. Further, the fry scoop with cells according to the present invention substantially departs from the conventional concepts and designs of the prior art, and in doing so provides a device primarily developed for the purpose of locating condiments with food so a consumer can season food to taste.

SUMMARY OF THE INVENTION

Generally, the present invention provides a single piece container for long foods, although it could also be used to hold sandwiches. The container comprises a blank with a rear panel, a rear wall, a bottom, a front wall with flanking side panels, and a front panel. The panels fold onto their respective walls and the walls fold upwardly from the bottom. The sides then fold and attach to the rear wall. With the sides, front wall, and rear wall upright upon the bottom, an open top food container forms. Further, pulling the front and rear panels inward toward the center of the present invention opens two condiment cells. The consumer or the restaurant staff can place packaged or bulk condiments in the cells.

Preferably, the front and rear panels have similar edges and attain the same height from the bottom. This provides for stability. The similarity between the front and the rear of the present invention provides for stability, and allows the restaurant staff to load the scoop from the front or the rear. With the sides attaching to the rear wall, the front wall provides an appealing appearance for a consumer.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved fry scoop with cells from a single blank.

Another object is to provide such a scoop that is easy to assemble.

Another object is to provide such a scoop and components parts made from a single material or blanks to minimize cost.

Another object is to provide such a scoop with both front and rear walls at the same height and shape for enhanced appearance and stability.

Another object is to provide cells from expanded panels to store bulk and prepackaged condiments such as ketchup, mustard, mayonnaise and relish.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 1:
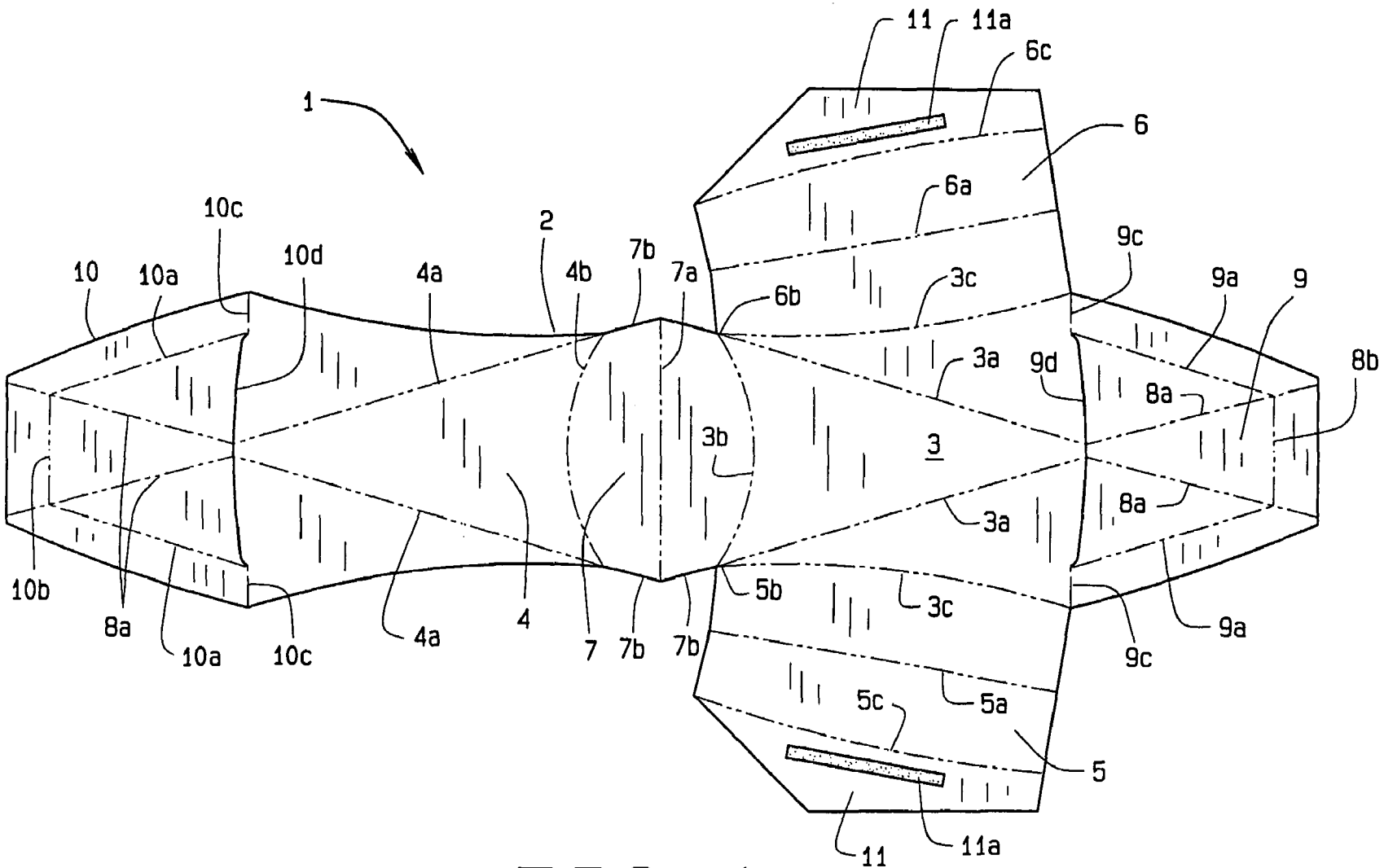
FIG. 1 shows a plan view of a blank of the embodiment of the food or fry scoop with cells assembled in accordance with the principles of the present invention.

The present art overcomes the prior art limitations by having one or two cells at the same elevation as the top edge of the front and rear walls. Initially, this allows stability if the structured scoop. Beginning on FIG. 1, the preferred embodiment of the fry scoop with cells 1, starts as a flat blank 2 of somewhat T shape with seven contiguous sections. The present invention serves as a food container 1. The blank 2 begins with the first condiment section, or the rear panel 10. The rear panel 10 has a trapezoidal shape, consisting of parallel short and long bases joined by sides. The short base of the trapezoid is away from the interior of the blank 2. The rear panel 10 has creases 10*a, b* that bend slightly inwards of the assembled present invention 1. These creases 10*a, b* are inset and parallel to the two edges and the short base of the rear panel 10. The rear panel 10 has two additional creases 8*a* extending from the corners of the short base generally towards the center of the long base of the trapezoidal shaped condiment rear panel 10. The additional creases 8*a* bend outwards and opposite the prior creases 10*a, b*. All of the creases 8*a*, 10*a*, and b on the rear panel 10 merely bend the blank 2 and do not penetrate the blank 2.

The rear panel 10 connects at a fold to the rear wall 4 on two shoulders 10*c* with a score 10*d* between them. The long base of the rear panel 10 is centered upon the long base of the rear wall 4. Each portion has perforations so the rear condiment panel 10 folds one hundred eighty degrees and inside of the rear wall 4. Upon folding, the top of a cell 8 appears and the rear panel 10 has a slightly inward concave edge 10*d* of the same elevation as the rear wall 4.

Next, the rear wall 4 has a generally trapezoidal shape of greater length than the rear panel 10. As the second section, the rear wall 4 has a long base that connects with the rear panel 10 and the short base of the rear wall 4 is towards the interior of the blank 2. The sides of the rear wall 4 have a generally is concave edge. Generally from the center of the scoring upon the long base, two creases 4*a* extend expansive towards the corners of the short base. The creases 4*a* extend outward of the assembled present invention 1 and extend for nearly the full length of the rear wall 4. At the short base, the rear wall 4 connects to the bottom 7 with an arcuate fold 4*b*. This curved fold serves to keep the structure "set up" in its erected state.

The bottom 7, or the third section, has a generally ovoid shape though truncated at each end. The truncation generally squares the edges 7*b* of the bottom 7 to abut the left side 5 and the right side 6 of the assembled present invention 1 as described later in FIG. 6. The bottom 7 has two mutually convex folds 3*b*, 4*b* that fold the rear 4 and front walls 3 approximately ninety degrees (90°) upwardly from the plane of the blank 2. At the center of the bottom 7, perpendicular to the length of the blank 2, the bottom 7 has a crease 7*a* that fold upwards and somewhat into the assembled present invention 1. The crease 7*a* provides rigidity to the bottom 7 and the present invention 1. Opposite and symmetric to the fold 4*b* with the rear wall 4, the bottom 7 has a fold 3*b* with the front wall 3.

Next, the front wall 3 has a generally trapezoidal shape of similar length as the rear wall 4 and greater length than the rear condiment panel 10. The front wall 3 forms the fourth section. The long base of the front wall 3 connects with the front panel 9 and the short base of the front wall 3 is towards the interior of the blank 2, when the carton is erected. The sides of the front wall 3 have a generally concave shaped fold 3*c* with perforations. The left side 5 and the right side 6 of the present invention 1 are contiguous with the front wall 3. Generally from the corners of the short base, the two creases 3*a* extend towards the center upper of the edge long base. The creases 3*a* bend outwards of the assembled present invention 1 and extend for nearly the full length of the front wall 3.

The front condiment panel 9 connects at a fold to the front wall 3 on two shoulders 9*c* with a separating score 9*d* between them. The long base of the front panel 9, or the fifth section, is centered upon the wider long base of the front wall 3. Each shoulder 9*c* has perforations so the front panel 9 folds one hundred eighty degrees (180°) back and inside of the front wall 3. Upon folding, the top of a second cell 8 forms and the front panel 9 has a concave edge 9*d* of the same elevation as the front wall 3.

The front condiment panel 9 has a trapezoidal shape. The short base of the trapezoid is away from the interior of the blank 2 and opposite that of the front panel 9. The front panel 9 has creases 9*a, b* that bend inwards of the assembled present invention 1. These creases 9*a*, 9*b* are inset and parallel to the two edges and the short base of the front panel 9. The front panel 9 has two additional creases 8*a* extending from the corners of the short base generally towards the center of the long base of the trapezoidal shaped front panel 9. The additional creases 8*a* bend upwards of the scoop and opposite the prior creases. All of the creases 8*a*, 9*a*, and 9*b* on the front panel 9 merely facilitate bending of the blank 2 and do not penetrate the blank 2.

Contiguous with the front wall 3, the left side 5, or the sixth section, extends away from the longitudinal axis and in FIG. 1, beneath the longitudinal axis. The left side 5 extends from a convex fold 3*c* upon the side of the front wall 3. The fold has perforations to form a ninety degree bend in the blank 2. The left side 5 has a generally polygonal shape with the short base towards the bottom 7 of the assembled scoop 1. A cut 5*b* separates the bottom 7 from the left side 5 where the short base is contiguous with the bottom 7. Opposite the short base, the left side 5 has a long base that extends away from the shoulder 9*c* of the front wall 3. The long base is generally parallel to the short base. Across from the fold 3*c* with the front wall 3, the left side 5 has a flap 11 of somewhat triangular shape. The base of the triangle extends outward from the long base of the left side 5 and the hypotenuse of the triangle is generally a concave fold 5*c* symmetrically to the opposite fold 3*c* between the left side 5 and the front wall 3. The vertex of the triangle is slightly above the short base of the left side 5 and symmetric with the start of the slice 5*b*. In the assembled invention 1, the base of the flap 11 stiffens the top edge of the rear wall 4.

Opposite the left side 5 and contiguous with the front wall 3, the right side 6, or the seventh section, extends away from the longitudinal axis of the scoop blank. The right side 6 extends from a convex fold 3*c* upon the side of the front wall 3. The fold 3*c* has perforations to form a ninety degree bend in the blank 2. The right side 6 has a generally trapezoidal shape with the short base towards the bottom 7 of the assembled invention 1. The right side is a mirror image of the left side 5. A cut 6*b* separates the bottom 7 from the right side 6 where the short base is contiguous with the bottom 7. Opposite the short base, the right side 6 has a long base. The long base is generally parallel to the short base and extends from the shoulder 9*c* of the front wall 3. Opposite the convex fold 3*c* with the front wall 3, the right side 6 has a flap 11 of somewhat triangular shape. The base of the triangle extends outward from the long base and the hypotenuse of the triangle is generally a concave fold 6*c* symmetric to the fold between the right side 6 and the front panel 9. The vertex of the triangle is slightly above the short base of the right side 6 and symmetric with the start of the cut 6*b*. Prior to folding the blank 2 into a familiar scoop like shape, machinery applies lines of glue 11*a* to the flaps 11. The flaps 11 adhere to the rear wall 4 opposite the rear condiment panel 10 and serve to secure the assembled present invention 1.

Figure 2:
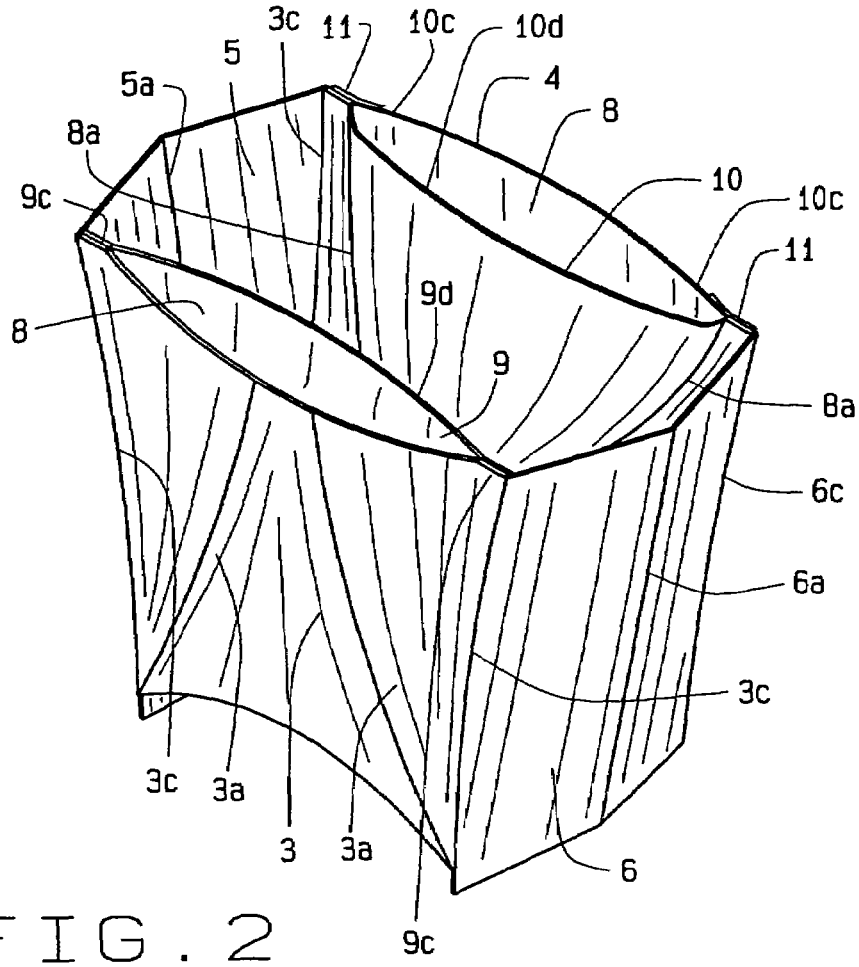
FIG. 2 shows an isometric view of the embodiment of the fry and food scoop with cells.

Upon folding, the present invention 1 assembles into a scoop shown in an isometric view in FIG. 2. In this view, the cells 8 form from the rear panel 10 folding upon the rear wall 4 and the front condiment panel 9 folds upon the front wall 3. Both cells 8 extend into the scoop and have an inside edge 9*d*, 10*d* at the top edge 9*d*, and 10*c* of their respective walls 3, 4. The front wall 3 and the rear wall 4 both have parallel or generally linear top edges 9*c*, 10 at the same elevation from the bottom 7. Outwards of the top edges 9*c*, 10*c* of the walls 3, 4, the left side 5 and the right side 6 may have square edges at the same elevation, or be cut lower.

Opposite the top edges of the scoop 1, the bottom 7 has a generally arcuate shape with the center at higher elevation than when the bottom 7 joins the left side 5 and the right side 6. Also, the top edges may be linear, or may be either scalloped or fluted to offer both a decorative and yet functional element to assist in the forming of the condiment cells.

Figure 3:
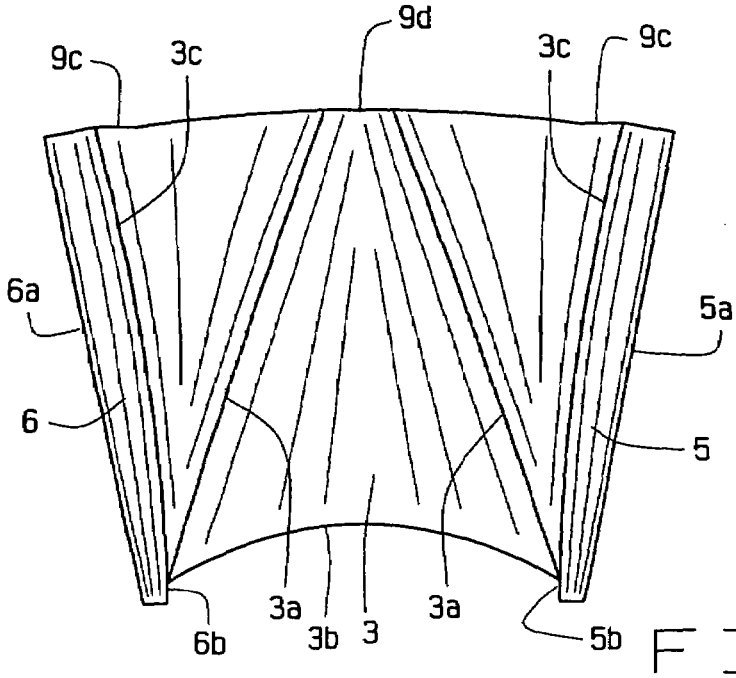
FIG. 3 shows a front view of the present invention.

FIG. 3 shows the front of the scoop. The front wall 3 has a tapering trapezoidal shape with the wide base as the linear top edge and the narrow base as the concave fold 3*b* to the bottom 7. The two creases 3*a* allow the front wall 3 to bend outwards of the present invention 1. The front wall 3 and the rear wall 4 both have parallel generally linear top edges at the same elevation from the bottom 7. Opposite the top edges of the scoop, the bottom 7 has a generally arcuate shape with the center at higher elevation than the left side 5 and the right side 6. The left side 5 and the right side 6 extend rearward from the front wall 3 at the folds 3*c* to the crease 5*a*, 6*a* at the middle of the sides 5, 6.

Figure 4:
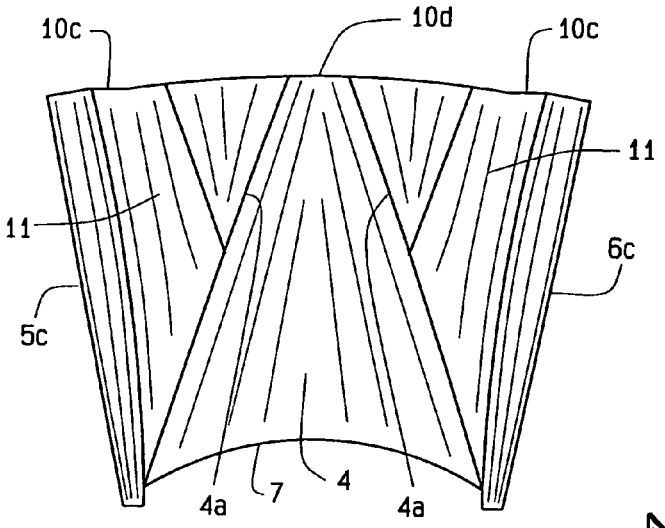
FIG. 4 shows a rear view of the present invention.

Opposite the front, FIG. 4 shows the rear of the scoop. The rear wall 4 has a tapering trapezoidal shape with the wide base as the convex top edge and the narrow base as the concave fold to the bottom 7. The two creases 4*a* allow the rear wall 4 to bend outwards of the present invention 1. The rear wall 4 has a substantially linear top edge similar to the front wall 3 and at the same elevation as the front wall 3. Opposite the top edges of the scoop, the bottom 7 has a generally arcuate shape with the center at higher elevation than the left side 5 and the right side 6. The flaps 11 fold upon and glue to the rear wall 4 opposite the rear panel 10. Then the left side 5 and the right side 6 extend rearward from the rear wall 4 at the folds 3*c* to the creases 5*a*, 6*a* at the middle of the sides 5, 6.

Figure 5:
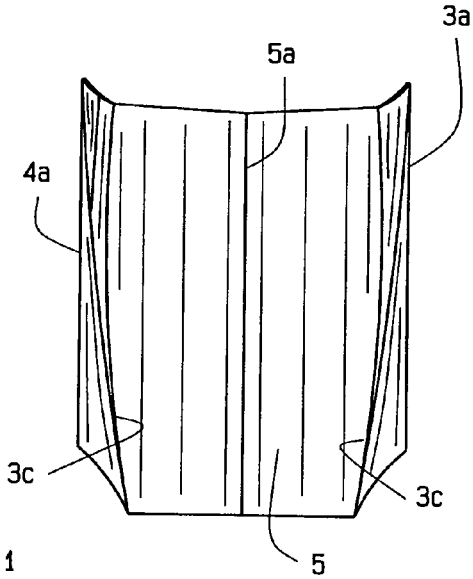
FIG. 5 shows a side view of the present invention.

Turning to the present invention 1, FIG. 5 shows the side 5, 6 of the present invention 1. The side 5, 6 has a generally trapezoidal shape with the short base at the bottom 7 of the present invention 1 and the long base forming a square top edge of the present invention 1. The vertical edges of the side have a convex edge formed by folds 3*c*, 5*c*, and 6*c*. Extending vertically in the center of the side 5, 6, a crease 5*a*, 6*a* allows the side to fold outward from the present invention 1.

Figure 6:
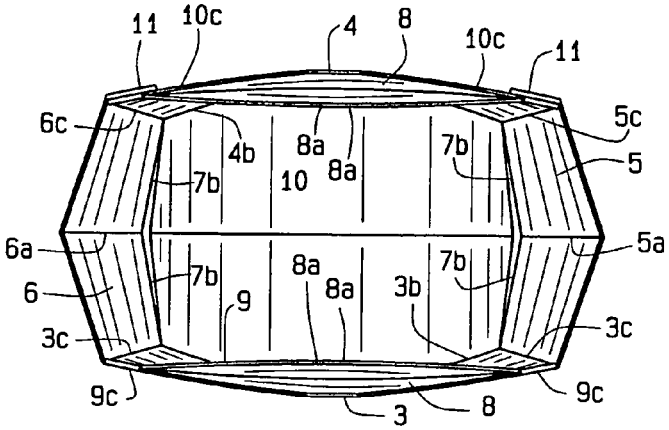
FIG. 6 describes the top view of the present invention.

Seen from the top in FIG. 6, the present invention 1 has openings for food and two condiment cells 8. The cells 8 form when the rear panel 10 folds inward and over the rear wall 4 and the front panel 9 folds inward and over the front wall 3. Using the creases 8*a* in the rear 10 and front panels 9, the cells 8 extend into the present invention 1. When open, the cells 8 received bulk or packaged condiments. In this view, the bottom 7 has a generally oval shape but truncated. The bottom 7 has opposite straight edges that abut the sides while leaving a small opening. Near the rear cell 8, the left flap 11 and the right flap 11 overlay the rear wall 4 adjacent to the shoulders 10*c*. In the assembled invention 1, the shoulders 10*c* have three thicknesses of material. However, the front cells 8 have two thicknesses of material at the shoulders 9*c*.

Figure 7:
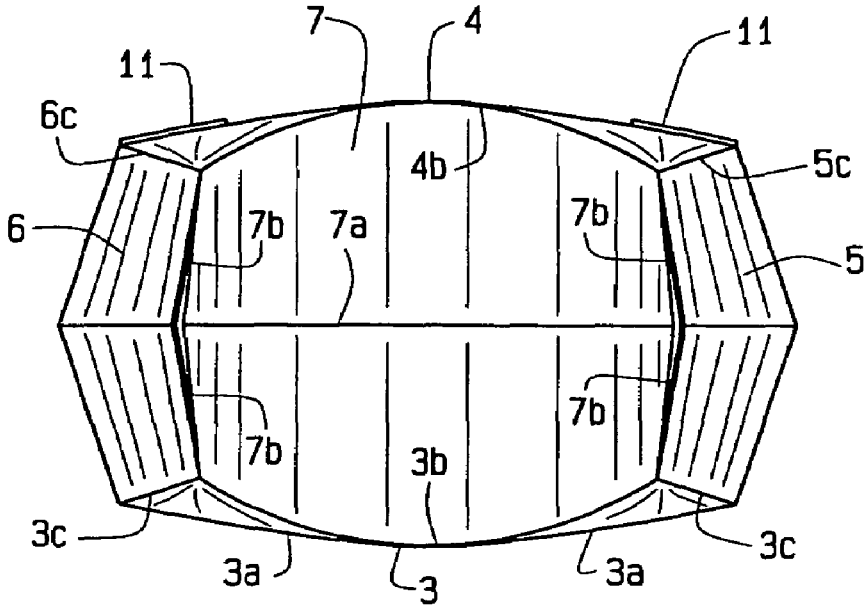
FIG. 7 shows a bottom view of the present invention.

Turning to the present invention 1, FIG. 7 illustrates the bottom 7 of the fry scoop with cells 8. As before, the bottom 7 has a truncated semi oval shape with convex edges at the folds 3*b*, 4*b*. Upon the longitudinal axis of the bottom 7, a crease 7*a* bends upwards, raising the bottom 7 towards the interior of the present invention 1. The bottom 7 then forms a convex surface to support food within the fry scoop 1. The truncated edges of the bottom 7 abut the left side 5 and the right side 6 but allow an opening to appear at both edges. From the bottom 7, the front wall 3, the rear wall 4, the left side 5, and the right side 6 taper outwards with greatest taper at the top edges of the fry scoop 1.

Figure 8:
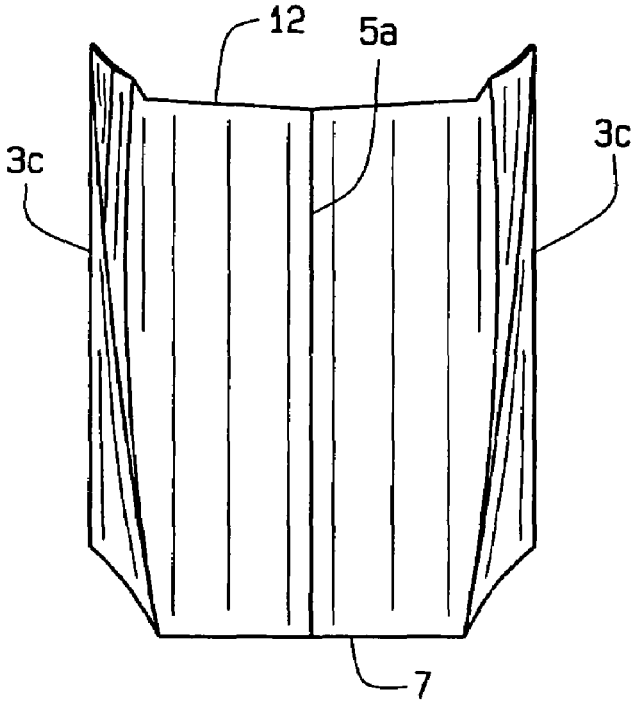
FIG. 8 illustrates a side view of an alternate embodiment of the present invention.

Turning to the present invention 1 again, FIG. 8 shows an alternate embodiment of the left side 5 of the present invention 1. The left side 5 has a somewhat trapezoidal shape with the short base near the bottom 7 and the long base having an edge with a recess 12, opposite the short base. The recess 12 is square and symmetric with angled edges that connect the long base to the shoulders 9*c* at the same elevation as the right side 6. The vertical edges of the side 5 have a convex shape as before formed by folds 3*c*, 5*c*. Extending vertically in the center of the side, a crease 5*a* allows the side 5 to fold outward from the present invention 1.

Figure 9:
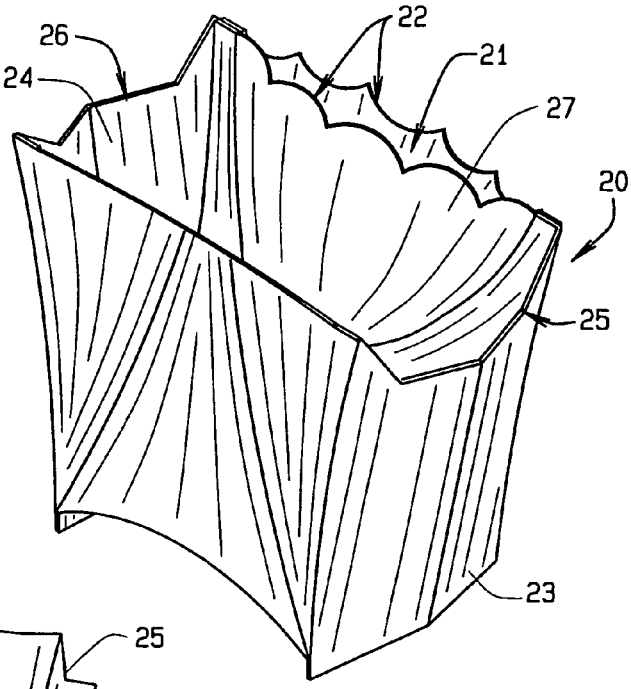
FIG. 9 shows an isometric view of a modification to an embodiment of the fry and food scoop with a singular cell.

FIG. 9 shows a modification to the scoop of this invention, as noted at 20, and this particular scoop is constructed very similarly to that embodiment as previously described. In this instance, there is a singular cell 21 provided on just one of the walls of the scoop, related to that as previously described with respect to the scoop of FIG. 2. In this instance, the upper edges of both the wall, and the cell that attaches thereto, may be scalloped, fluted, have an undulating appearance, generally to add to the decorativeness of the product. These can be seen at 22. In addition, the side walls 23 and 24 for the shown scoop may have cutouts, as at 25 and 26, respectively, which provide a lower appearance to the establishment of the side walls within the structure of the scoop, and likewise, provide a little clearance for the entrance or removal of any french-fry, or the like, that may be supplied therein. Otherwise, the fry scoop is made generally in accordance with the type of construction as defined in FIG. 2, and as shown in its blank configuration, in FIG. 1. The difference, though, is that the scoop will be void of one of the front panel 10 or rear panel 9, since only a singular cell is being formed therein, as previously reviewed at 21.

Figure 10:
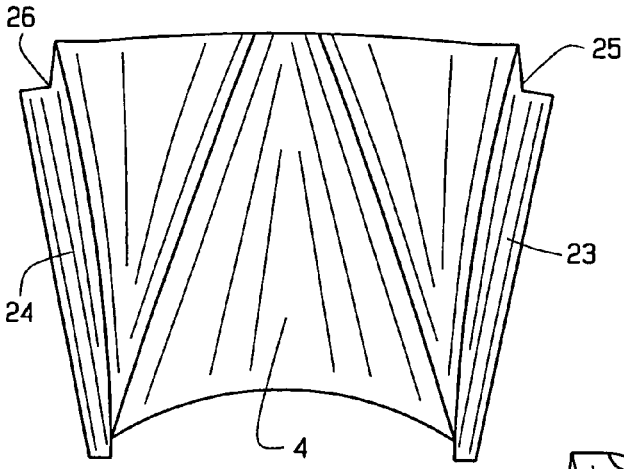
FIG. 10 is a front view thereof.
Figure 11:
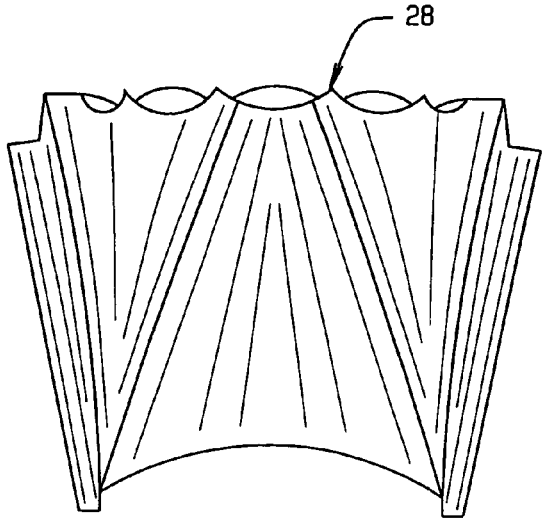
FIG. 11 is a back view thereof.

Essentially, though, as can be noted from FIGS. 10 and 11, the rear wall 4, and the front wall 27, along with the upper edge of the cell, as formed at 27, will all maintain the same height, so as to allow condiment to be supplied into the cell opening 21, and in addition, hold an adequate supply of french-fries therein, during usage. This can also be seen in FIG. 11, as noted for the various upper edges 28 for the shown scoop. This also adds balance and stability to the structured scoop during usage.

Figure 12:
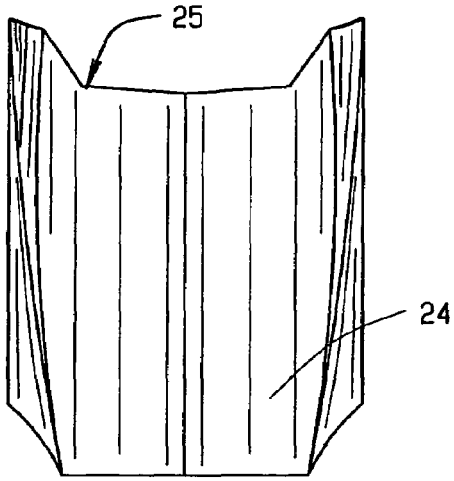
FIG. 12 is a side view.
Figure 13:
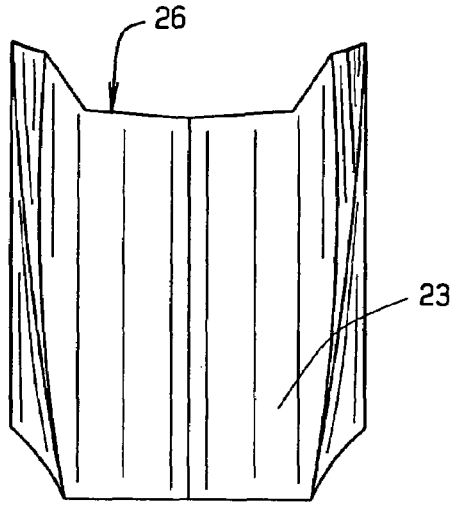
FIG. 13 is a left side view.
Figure 14:
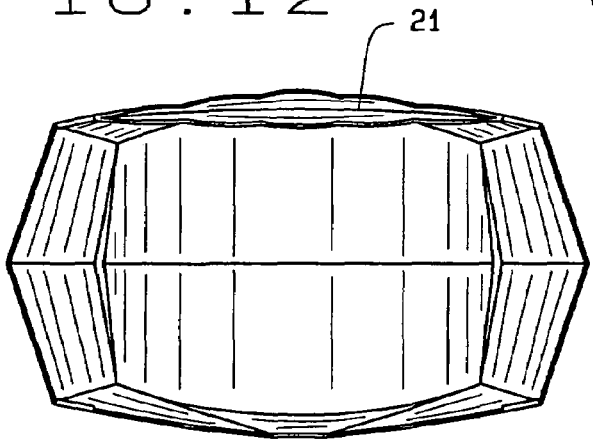
FIG. 14 is a plan view.
Figure 15:
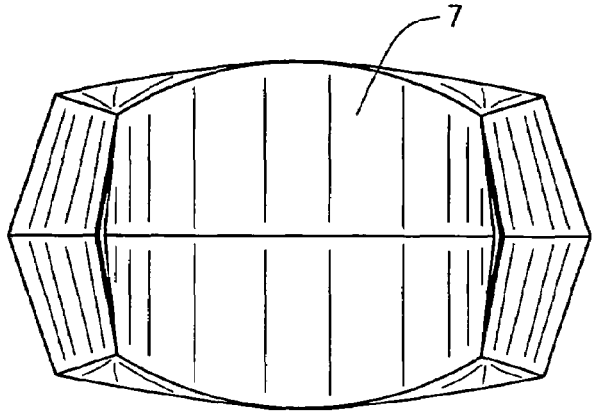
FIG. 15 is a bottom view.

FIGS. 12 and 13 show the cutout segments 25 and 26 as provided in the side walls 23 and 24, as can be seen. Furthermore, as can be noted in FIG. 15, which is a bottom view of the fry scoop, the size and dimensions for the scoop are such that the scoop will very conveniently fit within the standard car cup holder, and the idea of having a convenient "pouch" to dispense ketchup or other dipping sauces, and hold the french-fries or other food product therein, so that the occupants can consume the product from a convenient reach, for both the passenger, and even the driver.

Figure 16:
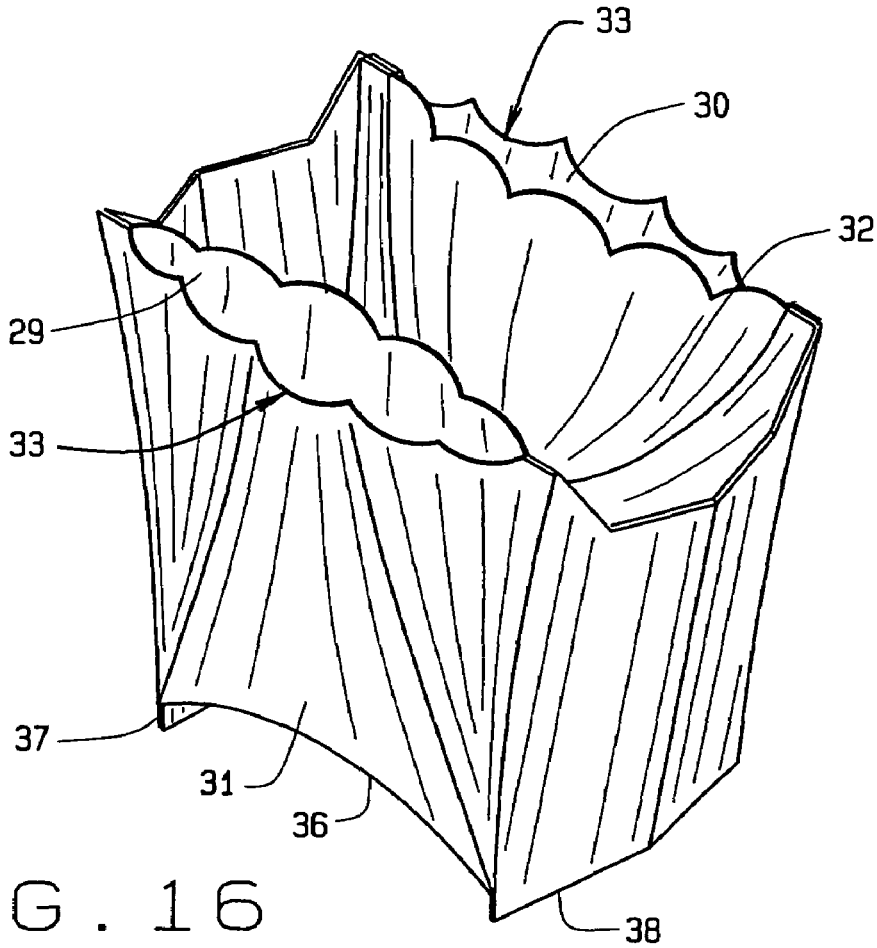
FIG. 16 shows an isometric view of a further modification of the embodiment for the fry and food scoop, in this instance having a pair of condiment cells.
Figure 17:
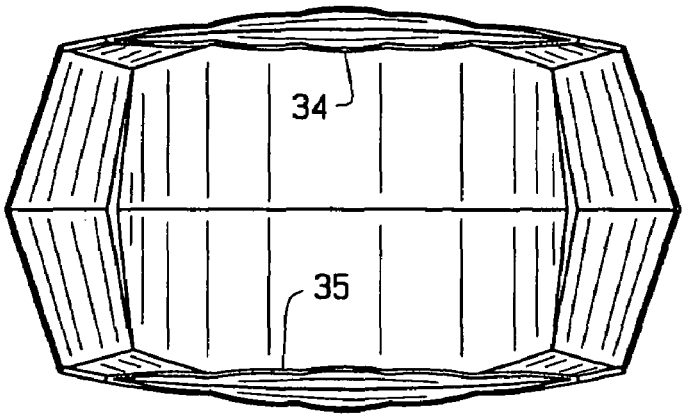
FIG. 17 is a top plan view thereof.

FIG. 16 shows a view of the fry scoop with a pair of cells 29 and 30 provided to both the front wall 31, and back wall 32, respectively. Once again, the upper edges of the various cells, and the front and back walls, are all aligned horizontally, are level with each other, and are fluted, scalloped, or otherwise designed, as noted at 33, to add to the attractiveness of the scoop. The inward buckling of the cell walls 34 and 35 can be conveniently seen in FIG. 17. This aids in the filling of any condiment therein. In addition, and as previously explained, when the fry scoop is opened, and its bottom wall is pressed upwardly, thereby forming the concaved style of bottom wall as can be clearly seen at 36, this provides for a sustained erection of the scoop, in its opened configuration, and allows a pair of base extensions 37 and 38 that may rest and support the ladened scoop directly upon any flat surface, such as a table top, when the scoop is placed into position for usage, and for dispensing of food, as for example at a fast food restaurant. These base edges 37 and 38 are formed at the lower edges of the side walls 5 and 6, and provides for their extension below the bottom of the cuts 5*b* and 6*b* as at the lower edges of the walls 3 and 4. This allows the bottom of the walls to square off upon a base, through their resting upon a flat surface and let the food scoop stand erect. With the symmetry provided between the walls in the upper part of the scoop and these flat legs 37 and 38 at the bottom of scoop, with the forcing upwardly of the base of the scoop, the entire food scoop remains upright, open and erect during usage.

From the aforementioned description, a fry scoop with cells has been described. The fry scoop with cells is uniquely capable of receiving condiments along with food within the expanded scoop. The fry scoop with cells and its various components may be manufactured from many materials including but not limited to paperboard, cardboard, chip board, polymers, high density polyethylene, polypropylene, polyethylene terephalate ethylene, polystyrene, nylon, ferrous and non-ferrous metal foils, their alloys, and composites.

The phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A food container formed from a single blank comprising:

a front wall;

a rear wall opposite said front wall;

a left side contiguous with said front wall and abutting said rear wall;

a right side opposite said left side and contiguous with said front wall, abutting said rear wall, and having the same elevation as said left side;

a bottom contiguous with said front wall and said rear wall and abutting said left side and said right side;

at least two cells within said container;

said front and rear walls and said at least two cells being generally the same height for stability;

a front panel hingedly connected to said front wall whereby said front panel folds upon said front wall generally towards the interior of said container, said front panel secures to said front wall leaving one edge open;

a rear panel hingedly connected to said rear wall whereby said rear panel folds upon said rear wall generally towards the interior of said container, said rear panel secures to said rear wall leaving one edge open;

the left side and said right side each having a contiguous flap, said flaps securing upon said rear wall;

said bottom having a longitudinal crease forming said bottom into an arcuate surface towards the interior of said container;

whereby said front wall, said right side, said rear wall, and said left side extend upwardly toward a top of said container and generally perpendicular from said bottom thereby containing food and said at least two cells;

said front wall and said rear wall each having a generally trapezoidal shape with a wide base forming a convex edge at the top of said food container and a narrow base forming a concave fold with said bottom, and said left side and said right side each having a generally oval shape with truncated ends providing a square edge denoting lower and upper edges of said left side and said right side;

said front panel and said rear panel each form at least one of said at least two cells to receive condiments, said cells having the same elevation; and said flaps and said bottom provide rigidity for said food container.

2. The food container of claim 1 wherein said bottom is raised above a lowest edge of said left side and said right side, and the lower edges of said left and right sides being squared to provide support and stability when said food container is stood upon a flat surface.

3. The food container of claim 1 further comprising:

a recess along the top edge of said left side, said recess extending over one third the depth of said container and having a square edge.

4. The food container of claim 1 wherein said front wall and said rear wall each having one or more creases extending from lower corners of said corresponding front and rear walls inward toward a center of a top edge of said corresponding front and rear walls, said left side and said right side each having a centered crease, and said cells having one or more creases in said rear panel and said front panel extending from lower corners of said corresponding rear and front panels inward toward a center of a top end of said corresponding rear and front panels;

whereby, said front wall, said rear wall, said left side, and said right side expand outwards from said food container.

5. The food container of claim 1 wherein the left side and right side provide cutouts at their upper edges, provide greater clearance for entry into the container.

6. The food container of claim 1 wherein at least one of the front wall and rear wall, in addition to the upper edge of said one or more cells are contoured to add to their attractiveness.

7. The food container of claim 1 wherein there are two cells provided within said container.

* * * * *